United States Patent [19]

Hancock

[11] 4,251,892

[45] Feb. 24, 1981

[54] BOX SPRING ASSEMBLY WITH ARCUATE BENDABLE SPRINGS

[75] Inventor: William L. Hancock, Lexington, Ky.

[73] Assignee: Hoover Universal, Inc., Saline, Mich.

[21] Appl. No.: 64,050

[22] Filed: Aug. 6, 1979

[51] Int. Cl.[3] ..... A47C 23/02; A47C 23/05

[52] U.S. Cl. ..... 5/255; 5/476

[58] Field of Search ..... 5/247, 255, 267, 476, 5/478, 479, 260, 263

[56] References Cited

U.S. PATENT DOCUMENTS

| | | | |
|---|---|---|---|
| 2,454,965 | 11/1948 | Elder | 5/255 |
| 2,494,432 | 1/1950 | Elder | 5/247 |
| 2,611,138 | 9/1952 | Piliero | 5/247 |

*Primary Examiner*—Roy D. Frazier
*Assistant Examiner*—Alexander Grosz
*Attorney, Agent, or Firm*—Olsen and Stephenson

[57] ABSTRACT

A box spring assembly which includes a generally rectangular frame, a plurality of upwardly extending wire springs mounted on the frame, and a wire grid supported on the upper ends of the springs so that the grid and springs cooperate to yieldably resist downwardly directed bedding loads. Each of the springs has a body comprised of two side-by-side arcuate portions formed integral at their upper ends with torsion bars that are connected by a connecting bar located between the arcuate portions. The arcuate body portions thus resist bedding loads with bending stresses and without any areas of stress concentration that would cause early spring failure. The torsion bars in each spring divide the spring load and resist bedding loads principally with torsional stresses, the combination of both bending and torsional stresses in the springs enabling increased load-resisting capabilities in the springs with a resulting efficient use of spring wire material.

11 Claims, 4 Drawing Figures

BOX SPRING ASSEMBLY WITH ARCUATE BENDABLE SPRINGS

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; and 3,852,838. Box spring assemblies of the general type shown in the above list of patents, all of which are assigned to the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,596,299; 3,722,013; 3,825,960; 3,833,948; 3,835,485; 3,869,740; 3,990,121; and 4,000,531.

The present invention provides a box spring assembly which utilizes a different spring from the formed wire springs utilized in the patented box spring assemblies discussed above. The spring in the present box spring assembly can be constructed of minimum width thereby imparting versatility to the assembly in terms of strength, stiffness, and cost because the number of springs used can readily be varied, this versatility being an inherent feature of the spring achieved by virtue of the spring configuration. Furthermore, the spring is constructed with a combination of arcuate bendable portions and torsion bars enabling it to resist loads in both bending and torsion to achieve an efficient use of spring material.

It is an object of the present invention, therefore, to provide an improved box spring assembly having springs with upright arcuate portions that resist bedding loads by bending.

SUMMARY OF THE INVENTION

The box spring assembly of this invention consists of a rectangular frame having side rails, end rails, and a plurality of cross rails that are generally parallel and are substantially perpendicular to the side rails. A plurality of wire springs are mounted on the cross rails and connected to each other so as to yieldably resist downwardly directed bedding loads. Each of the springs is formed of spring steel wire and has a body comprised of two side-by-side arcuate portions. Each of the arcuate portions is upright and is formed integral at its lower end with a mounting foot secured to one of the cross rails so that in response to downwardly directed loads, the body portion will bend in a substantially vertical plane to provide yieldable resistance to loads. In a preferred form of the invention, the arcuate portions are generally semi-circular in shape and thus avoid any areas of stress concentration that might weaken the springs during bending in response to load.

The arcuate portions are formed integral at their upper ends with a pair of torsion bars located so that the torsion bars in each spring body are in substantially the same horizontal plane and are spaced horizontally. The upper ends of the spring body portions overlap and a connecting bar, which extends between the torsion bars, is positioned generally between the upper ends of the arcuate portions. This construction causes the torsion bars to resist bedding loads with torsional stresses and the provision of the connecting bar generally midway between the spring body portions provides for a dividing of the bedding load between adjacent torsion bars. The result is a minimum width spring which is very effective in resisting bedding loads even though it is small in size. The size of the spring enables the use of a few or many of the springs in a box spring assembly, depending upon strength, stiffness, and cost requirements.

A wire grid having some wires parallel to and disposed on top of some of the torsion bars and other wires parallel to and disposed on top of the connecting bars is secured to the springs by conventional clips which secure the grid wires to the spring bars. The wire grid is effective in transferring downwardly directed loads to the springs which are also capable of being loaded directly since bedding loads are transmitted through the usual mattress which is disposed on top of the wire grid, but which, by virtue of its flexibility, also engages the tops of some of the springs directly.

Further objects, features, and advantages of this invention will become apparent from a consideration from the following description, the appended claims, and the accompanying drawing in which:

Figure 1:
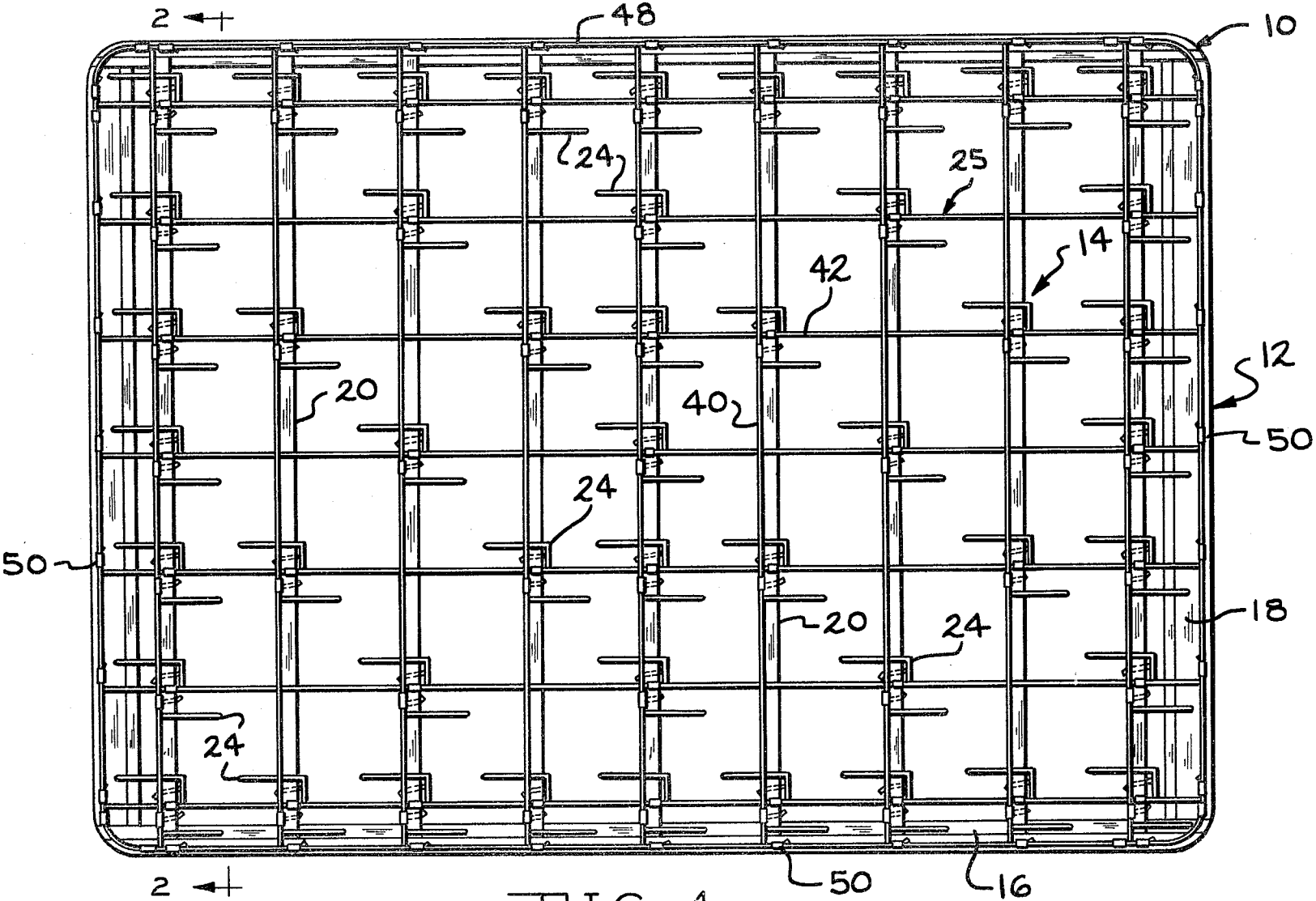
FIG. 1 is a plan view of the box spring assembly of this invention.

With reference to the drawing, the box spring assembly of this invention, indicated generally at 10, is illustrated in FIG. 1 as consisting of a generally rectangular, horizontally disposed frame 12 and a wire spring assemblage 14 mounted on the top side of the frame 12. The frame 12 has side rails 16 and end rails 18 which are usually formed of wood, and a plurality of generally parallel cross rails 20, illustrated as being formed of metal (FIG. 3), secured to and extending between the side rails 16. The metal cross rails 20 (FIGS. 2 and 3) are formed with spring-mounting slots 22 for a purpose to be described in greater detail hereinafter. It is to be understood that wooden cross rails can be used as an alternative to the illustrated metal cross rails 20.

The spring assemblage 14 consists of a plurality of springs 24 and a wire grid 25 supported on and secured to the upper ends of the springs 24.

Figure 4:
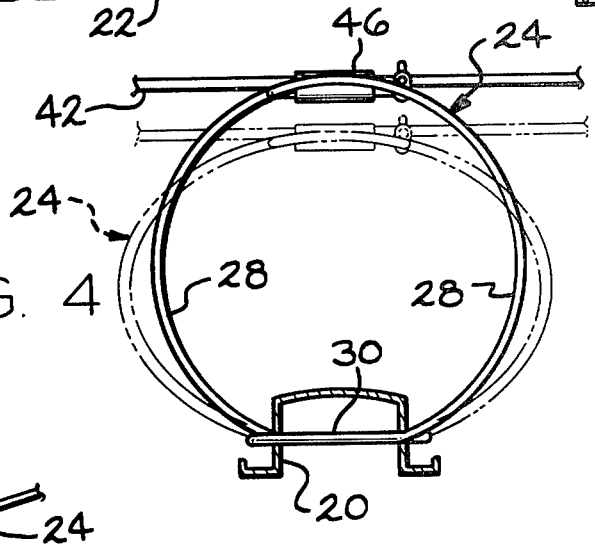
FIG. 4 is a transverse sectional view of a portion of the box spring assembly of this invention, showing one of the springs in a deflected position in broken lines and in an undeflected position in solid lines.

Each of the springs 24 is formed from a length of spring steel wire bent to form a body 26 having a pair of upright arcuate portions 28 which are arranged side-by-side and are formed at their lower ends with mounting feet 30. As shown in FIG. 4, the portions 28 are shaped so that the spring presents a generally circular profile when viewed from the side. The structure of the feet 30 and their interaction with the cross rail slots 22 so as to mount the springs 24 on the frame 12 are well known and are described in detail in applicant's prior U.S. Pat. No. 3,680,157, referred to above.

The arcuate portions 28, in the preferred form of the present invention, are generally semi-circular in shape, although it is to be understood that it is within the purview of the present invention to use other arcuate shapes, the portions 28 in each spring 24 being extended at their upper ends to provide for the overlap of upper end sections 29. By "overlap", it is meant that a vertical plane can be passed through the body 26 which will intersect both arcuate portions 28 at their upper ends.

A torsion bar 32 is formed integral with the top end of each spring portion 28 and is arranged so that it extends toward the top end of the other spring portion 28. The torsion bars 32 are disposed in a common, horizontal plane and are connected by a connecting bar 34 that is generally perpendicular to the torsion bars 32.

The wire grid 25 consists of a plurality of first generally parallel, horizontally spaced straight wires 40 and a plurality of other straight wires 42 which are generally perpendicular to the wires 40 and are also spaced apart horizontally.

Figure 2:
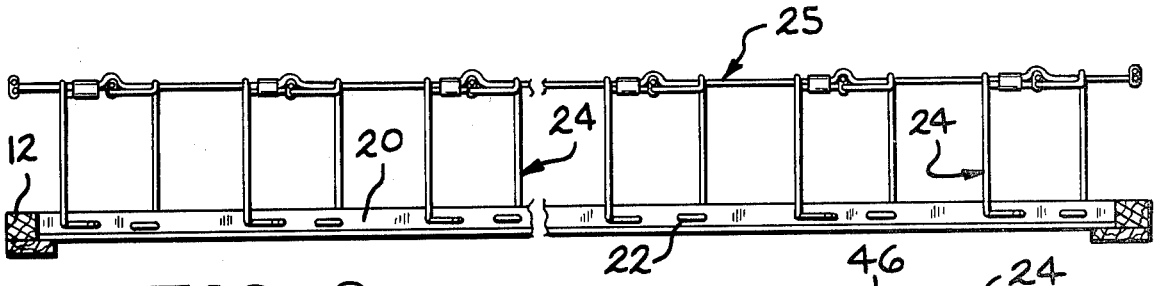
FIG. 2 is a transverse sectional view of the box spring assembly of this invention, as seen from substantially the line 2—2 in FIG. 1, with a center portion of the assembly removed for purposes of clarity.
Figure 3:
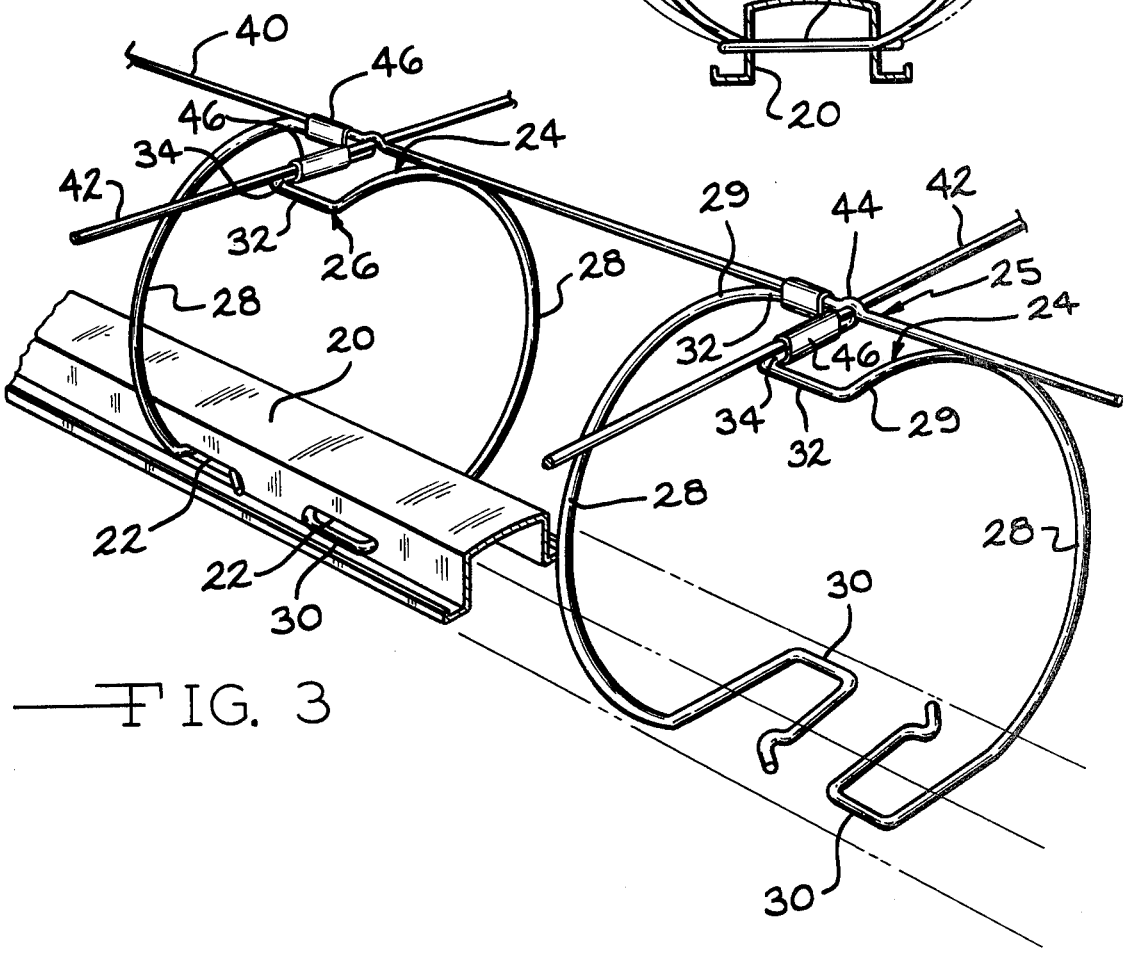
FIG. 3 is a perspective view of a portion of the box spring assembly of this invention.

As shown in FIGS. 2 and 3, the wires 40 are provided with upwardly extending arcuate offsets or bends 44, sometimes called "notches", which are disposed on top of the wires 42 to enable the wires 40 and 42 to be located in the same horizontal plane. The wires 40 are aligned vertically with some of the torsion bars 32 and are supported on the top sides of those torsion bars 32. The wires 42 are aligned vertically with the connecting bars 34 and are supported on the top sides of the bars 34.

Conventional wrap-around clips 46 are used to connect the wires 40 to the adjacent torsion bars 32 and to connect the wires 42 to the connecting bars 34. The notches 44 in the wires 40 enable the wires 40 to directly engage the top sides of the bars 32 so that all of the clips 46 connect pairs of vertically aligned and engaged wires. This facilitates direct transfer from the grid 25 to the springs 24 of bedding loads. It is apparent that different ones of the wires 40 and 42 can be notched so long as the result is a grid 25 in which all wires are in a common horizontal plane.

The grid also includes a border wire 48 secured by clips 50 to the ends of the wires 40 and 42.

In the use of the box spring assembly 10, the usual yieldable mattress (not shown) or the like is supported on the horizontal wire deck formed by the grid wires 40, 42, and 48, some of the torsion bars 32, and the upper end sections 29 of the arcuate spring body portions 28. During the application of normal bedding loads to the mattress, these loads are transmitted to the box spring assembly 10 causing the spring portions 28 to bend toward their broken line positions shown in FIG. 4. Such loads are also resisted in torsion by the torsion bars 32 which act to divide the load in each spring assembly 24 between the portions 28. The feet 30 provide for a firm, immovable support of the springs 24 on the cross rails 20 so that the arcuate spring portions 28 and torsion bars 32 coact to resist bedding loads with a combination of bedding and torsional stresses. The result is an efficient use of metal in the springs 24 to provide a desired, yieldable resistance to bedding loads.

As shown in FIG. 2, the springs 24 are relatively narrow in width. This enables the use of as many or as few of the springs 24 as are desired in a particular box spring assembly; the more springs 24 that are used, the stiffer the assembly. During loading of the mattress that is supported on the wire grid, some of the mattress loads are transmitted directly to the springs 24 without going through the wire grid. For example, the torsion bars 32 that are not connected to the grid wires 40 are engaged directly by the mattress and are loaded to some extent in this manner. The same is true of the upper end sections 29 of the spring portions 28.

By virtue of the configuration of the spring end portions 28 and the integral formation therewith of the torsion bars 32 and the connecting bar 34, the torsion bars 32 act to divide the load applied to each spring 24 between the end portions 28 and the torsion bars 32. In the preferred form of the invention, the torsion bars 32 in each spring 24 are of equal length so that the spring body 26 is symmetrical about a vertical plane extending axially through the connecting bar 34, and with respect to a second vertical plane perpendicular to the first and bisecting the connecting bar. The result is a spring which is more or less uniformly stressed and does not have any points of stress concentration that might fail and shorten the life of the entire spring assembly 10.

From the above description, it is seen that this invention provides an improved box spring assembly 12 that includes novel springs 24 having upright, bendable arcuate portions 28. The springs 24 can be arranged on the frame 12 in a non-uniform spacing to best resist anticipated loads. As shown in FIG. 1, there is a higher concentration of springs 24 at the periphery and near the center of the frame 12 where loads are traditionally higher.

What is claimed:

1. In a box spring assembly which includes a generally horizontal, rectangular frame, a plurality of wire springs mounted on said frame and connected to each other so as to yieldably resist downwardly directed bedding loads, each of said springs being formed of spring steel wire and having a body comprised of two side-by-side arcuate portions, each of said arcuate portions being upright and being formed integral at its lower end with a mounting foot secured to said frame so that in response to downwardly directed loads said body portions will bend in substantially vertical planes, each of said arcuate portions being formed integral at its upper end with a torsion bar located so that the torsion bars in said body are in substantially the same horizontal plane and are spaced horizontally, a connecting bar extending between said torsion bars, and a wire grid supported on and secured to the upper ends of said springs.

2. The box spring assembly according to claim 1 wherein said wire grid includes a plurality of straight wires arranged criss-cross fashion, said wires being secured to said connecting bars and at least some of said torsion bars.

3. The box spring assembly according to claim 1 wherein said body portions are generally semi-circular in shape and curved in opposite directions so that said body presents a generally circular profile when viewed from the side.

4. The box spring assembly according to claim 3 wherein said connecting bar is located substantially midway between said body portions.

5. The box spring assembly according to claim 1 wherein said arcuate portions are relatively arranged so that said body is substantially symmetrical with respect to mutually perpendicular vertical planes extending through said connecting bar.

6. The box spring assembly according to claim 1 wherein said grid includes a first set of substantially parallel wires connected to said connecting bars and a second set of substantially parallel wires generally perpendicular to said first set and secured to some of said torsion bars, said grid and the upper ends of said body portions being in substantially the same horizontal plane as said torsion and connecting bars whereby downwardly directed bedding loads on said box spring assembly are transmitted directly to said body portions as well as through said grid.

7. The box spring assembly according to claim 1 wherein said grid includes a plurality of mutually perpendicular wires, some of said grid wires being notched at the junctures thereof with intersecting grid wires to locate all of said grid wires in substantially a common horizontal plane to thereby enable direct engagement of said grid wires with the top sides of said springs, and wrap-around clips extended about vertically adjacent portions of said grid and said springs to provide for direct transfer of loads from said grid to said springs.

8. A box spring assembly comprising a rectangular frame having side rails, end rails, and a plurality of cross rails that are generally parallel and are substantially perpendicular to said side rails, a plurality of wire springs mounted on said cross rails and connected to each other so as to yieldably resist downwardly directed bedding loads, each of said springs being formed of spring steel wire and having a body comprised of two side-by-side arcuate portions, each of said arcuate portions being upright and being formed integral at its lower end with a mounting foot secured to one of said cross rails so that in response to downwardly directed loads, said body portions will bend in substantially vertical planes, said vertical planes being substantially parallel and being generally perpendicular to said cross rails, each of said arcuate portions being formed integral at its upper end with a torsion bar located so that the torsion bars in said body are in substantially the same horizontal plane and are spaced horizontally in a direction generally perpendicular to said cross rails, a connecting bar extending between said torsion bars and positioned generally perpendicular to said torsion bars, and a wire grid having some wires substantially parallel to and disposed on top of said torsion bars and other wires substantially parallel to and disposed on top of said connecting bars, and clip means securing said grid wires to the bars on which they are disposed.

9. The box spring assembly according to claim 8 wherein the upper ends of said body portions are connected by said torsion and connecting bars.

10. The box spring assembly according to claim 8 wherein the connecting bar in each spring is located substantially midway between the upper ends of the spring body portions.

11. The box spring assembly according to claim 8 wherein enough of said grid wires are notched at the junctures thereof with intersecting grid wires to locate all of said grid wires in substantially a common horizontal plane to thereby enable direct engagement of said grid wires with the top sides of said torsion and connecting bars.

* * * * *